US008752240B2

(12) United States Patent
Pruiett

(10) Patent No.: US 8,752,240 B2
(45) Date of Patent: Jun. 17, 2014

(54) SUCTION NOZZLE WITH OBSTACLE SENSOR

(75) Inventor: Jason W. Pruiett, Grand Rapids, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 104 days.

(21) Appl. No.: 13/339,436

(22) Filed: Dec. 29, 2011

(65) Prior Publication Data

US 2012/0167331 A1 Jul. 5, 2012

Related U.S. Application Data

(60) Provisional application No. 61/427,966, filed on Dec. 29, 2010.

(51) Int. Cl.
*A47L 9/28* (2006.01)
*A47L 9/04* (2006.01)
*A47L 5/00* (2006.01)

(52) U.S. Cl.
USPC ..... 15/339; 15/319

(58) Field of Classification Search
USPC ..... 15/339, 319, 4
IPC ..... A47L 9/04,9/28
See application file for complete search history.

(56) References Cited

U.S. PATENT DOCUMENTS

| | | | | |
|---|---|---|---|---|
| 2,348,861 | A | | 5/1944 | Smellie |
| 3,936,903 | A | | 2/1976 | Johnson |
| 3,942,219 | A | | 3/1976 | Johnson |
| 4,023,234 | A | * | 5/1977 | Martinec et al. ..... 15/331 |
| 4,355,436 | A | | 10/1982 | Hertzberg |
| 4,499,682 | A | | 2/1985 | Piatt |
| 4,854,006 | A | | 8/1989 | Nishimura et al. |
| 5,020,186 | A | | 6/1991 | Lessig, III et al. |
| 5,054,156 | A | | 10/1991 | Watanabe et al. |
| 5,249,331 | A | | 10/1993 | Mitani et al. |
| 5,557,822 | A | | 9/1996 | Yagi et al. |
| 5,850,666 | A | | 12/1998 | Farone et al. |
| 6,039,817 | A | | 3/2000 | Payne |
| 6,434,786 | B1 | | 8/2002 | Roberts |
| 6,514,356 | B2 | | 2/2003 | Vystrcil et al. |
| 6,581,239 | B1 | | 6/2003 | Dyson et al. |
| 6,968,587 | B2 | | 11/2005 | Grey |
| 7,124,467 | B2 | | 10/2006 | Hitzelberger et al. |
| 7,134,164 | B2 | | 11/2006 | Alton |
| 7,146,682 | B2 | | 12/2006 | Damman et al. |
| 7,171,723 | B2 | | 2/2007 | Kobayashi et al. |
| 7,571,511 | B2 | | 8/2009 | Jones et al. |
| 2005/0138764 | A1 | * | 6/2005 | Grey ..... 15/377 |
| 2005/0166356 | A1 | * | 8/2005 | Uehigashi ..... 15/319 |
| 2007/0113373 | A1 | | 5/2007 | Hato et al. |
| 2008/0276407 | A1 | | 11/2008 | Schnittman et al. |
| 2010/0037418 | A1 | | 2/2010 | Hussey et al. |
| 2010/0107356 | A1 | | 5/2010 | Jakubos et al. |

FOREIGN PATENT DOCUMENTS

| | | | |
|---|---|---|---|
| CA | 2312623 | A1 | 12/2001 |
| DE | 2610866 | A1 | 9/1977 |
| GB | 2046087 | A | 11/1980 |

(Continued)

*Primary Examiner* — Monica Carter
*Assistant Examiner* — Stephanie Berry
(74) *Attorney, Agent, or Firm* — McGarry Bair PC

(57) ABSTRACT

A suction nozzle for a vacuum cleaner includes one or more sensor(s) to sense an obstacle near or proximate to the suction nozzle. A side brush can be rotated or a working air path can be diverted based on a signal from the sensor(s).

15 Claims, 13 Drawing Sheets

(56) References Cited

FOREIGN PATENT DOCUMENTS

| | | | |
|---|---|---|---|
| GB | 2378643 | A | 2/2003 |
| GB | 2421424 | A | 6/2006 |
| JP | 3272722 | A | 12/1991 |
| JP | 5317210 | A | 12/1993 |
| JP | 2003070704 | A | 3/2003 |
| JP | 2005245916 | A | 9/2005 |
| JP | 2006187477 | A | 7/2006 |

* cited by examiner

SUCTION NOZZLE WITH OBSTACLE SENSOR

CROSS REFERENCE TO RELATED APPLICATIONS

This application claims the benefit of U.S. Provisional Patent Application No. 61/427,966, filed Dec. 29, 2010, which is incorporated herein by reference in its entirety.

BACKGROUND

A vacuum cleaner can be used to remove dirt or debris from a wide variety of surfaces. The vacuum cleaner can comprise a suction source fluidly connected to an upstream aperture disposed near the one or more brushes to ingest the dirt into a working air path that is fluidly connected to a downstream filtration system. The filtration system is configured to separate the entrained dirt from the working airstream and convey the dirt into a removable dirt cup or a porous filter bag for later disposal. Vacuum cleaners can further comprise one or more brushes rotatably mounted onto sides of a foot portion of the vacuum cleaner to dislodge or sweep dirt near edges of the surface or near walls orthogonal to the surface to be cleaned.

BRIEF SUMMARY

According to one aspect of the invention, a suction nozzle for a vacuum cleaner comprises a nozzle body comprising a nozzle suction inlet fluidly interconnected to a source of suction, a first side brush rotatably mounted to the nozzle body near a side of the nozzle body, a first motor operably coupled with the first side brush for selectively rotating the first side brush, a controller operably connected to the first motor, and a first sensor operably connected to the controller and adapted to send an output signal to the controller upon sensing an obstacle. The controller energizes the first motor in response to the output signal from the first sensor.

According to another aspect of the invention, a suction nozzle for a vacuum cleaner comprises a nozzle body comprising a nozzle suction inlet, a first edge suction inlet provided near a side of the nozzle body, a first side brush rotatably mounted near the side of the nozzle body, a diverter assembly for selectively fluidly coupling one of the nozzle suction inlet and the first edge suction inlet with a source of suction and movable between a first position in which the nozzle suction inlet is fluidly coupled with the source of suction, and a second position in which the first edge suction inlet is fluidly coupled with the source of suction, a controller operably connected to the diverter assembly, and a first sensor operably connected to the controller and adapted to send an output signal to the controller upon sensing an obstacle. The controller moves the diverter assembly to the second position and rotates the first side brush in response to the output signal from the first sensor.

DETAILED DESCRIPTION

According to the invention, a vacuum cleaner comprises a sensor to detect a proximate wall. Throughout this description, the terms "upper," "lower," "right," "left," "rear," "front," "vertical," "horizontal," and derivatives thereof describe the invention as oriented in FIG. 1 from the perspective of a user behind the vacuum cleaner, which defines the rear of the vacuum cleaner.

Figure 1:
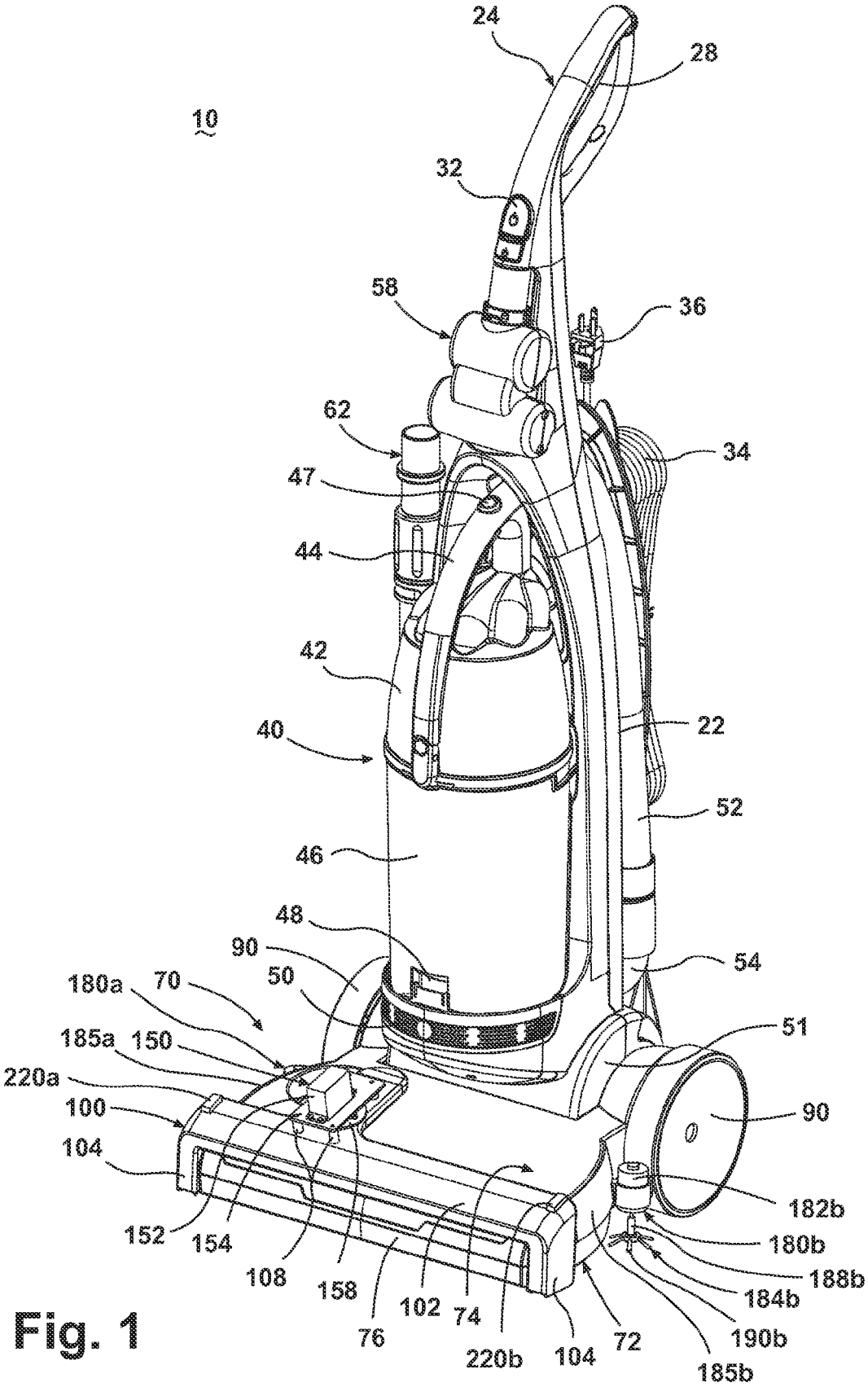
FIG. 1 is a front perspective view of a vacuum cleaner according to one embodiment of the invention.

Referring to FIG. 1, a vacuum cleaner 10 comprises a main body 40 pivotally mounted to a foot assembly 70. The main body 40 comprises a housing 22 with a handle 24 including a hand grip 28 disposed thereon for use in maneuvering the vacuum cleaner 10 over the surface to be cleaned, a power cord 34, a power outlet plug 36, and a power switch 32 to selectively energize the vacuum cleaner 10. The main body 40 further comprises a suction source with a suction motor (not shown), filtration chamber 42 for separating the dirt entrained in the working air stream, a removable dirt container 46 for holding dirt separated from the working air stream and that is selectively releasable from the main body 40 by a latch 47 for emptying the collected dirt, and a vent 50 for exhausting the working air stream to the ambient atmosphere downstream from a suction source 51. A live hose 52 is fluidly connected between the foot assembly 70 and the filtration chamber 42 when stored on the body as shown in FIG. 1, and is selectively removable from communication with the foot assembly 70 for above-the-floor cleaning, optionally using one or more accessory tools 58 and 62.

The foot assembly 70 comprises a top housing portion 74 fixedly attached to a bottom housing portion 72 with a cavity formed therebetween for receiving components therein. The foot assembly 70 further comprises a front housing portion 76, wheels 90 on both the left and right sides of the top housing portion 74 to translate the vacuum cleaner 10 over the surface to be cleaned, brush assemblies 180*a* and 180*b* on the right and left sides, respectively, of the top housing portion 74, rearward of the front housing portion 76, an edge nozzle assembly 100, and diverter assembly 150 to selectively divert the working air stream from a main nozzle, described below, to the edge nozzle assembly 100. The edge nozzle assembly 100 comprises a middle housing portion 102 and side housing portions 104 that wrap around the sides of the front housing portion 76.

Figure 2:
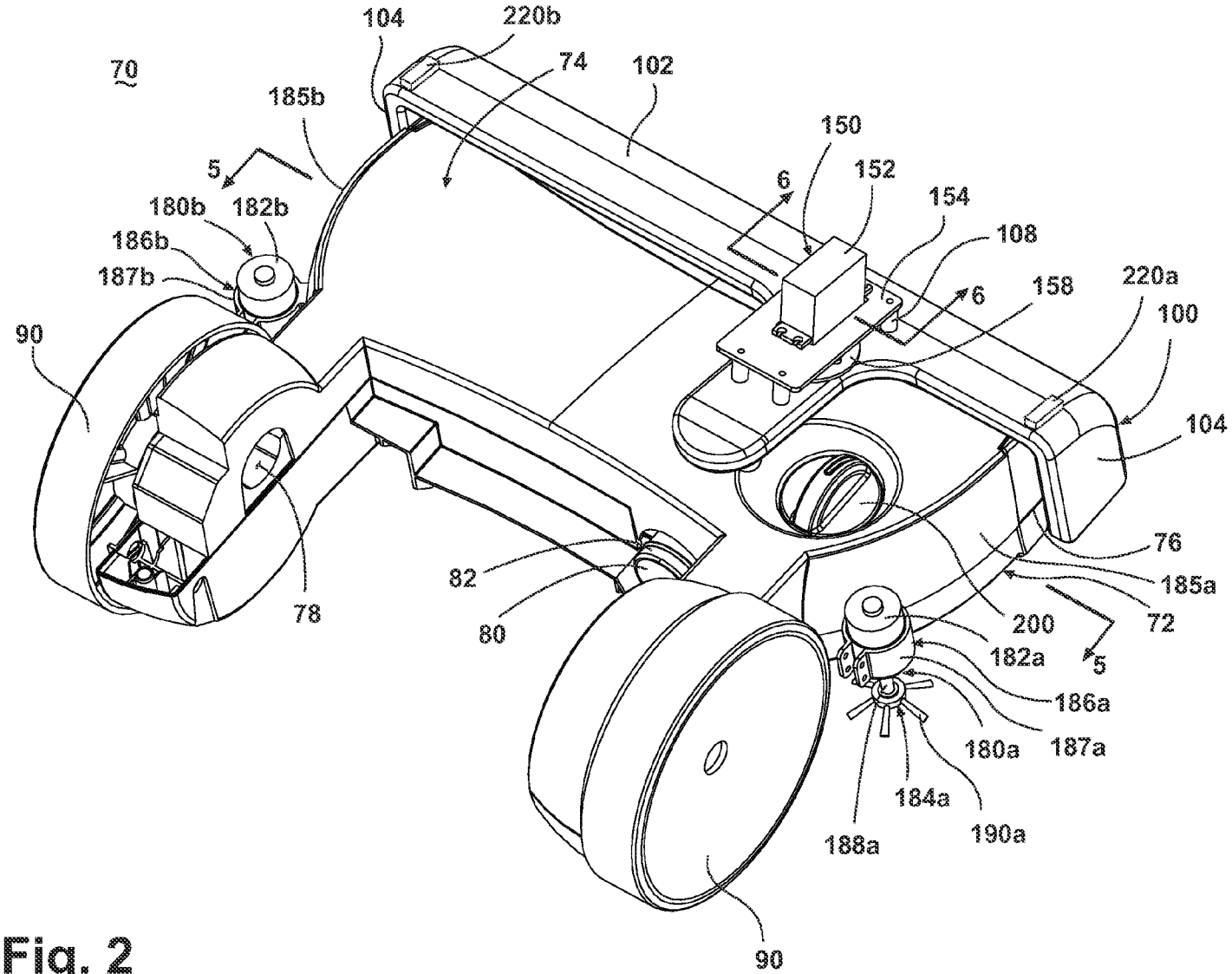
FIG. 2 is a rear perspective view of a foot assembly of FIG. 1 with an edge nozzle assembly.

Referring additionally to FIG. 2, the brush assemblies 180*a* and 180*b* comprise brush motors 182*a* and 182*b* attached to brushes 184*a* and 184*b*, and are mounted to the top housing portion 74 by brush assembly mounts 186*a* and 186*b*. The brush assembly mounts 186*a* and 186*b* comprise housing mounts 185*a* and 185*b* that attach the brush assemblies 180*a* and 180*b* to the sides of the top housing portion 74 and motor holders 187*a* and 187*b* attached to the housing mounts 185*a* and 185*b* for holding the brush motors 182*a* and 182*b*. The brushes 184*a* and 184*b* comprise of brush hubs 188*a* and 188*b* that are operably coupled with the brush motors 182*a* and 182*b*, and have brush tufts 190*a* and 190*b* protruding outwardly from the brush hubs 188*a* and 188*b* to sweep dirt from the surface to be cleaned.

Proximity sensors 220*a* and 220*b* are mounted on top of the edge nozzle assembly middle housing portion 102 near the right and left sides, respectively, to detect any objects proximate to one or both sides of the foot assembly 70. Protrusions (not shown) in the main body 40 may engage main body attachment recesses 78 in the foot assembly 70 to pivotally attach the main body 40 to the foot assembly 70.

Figure 3:
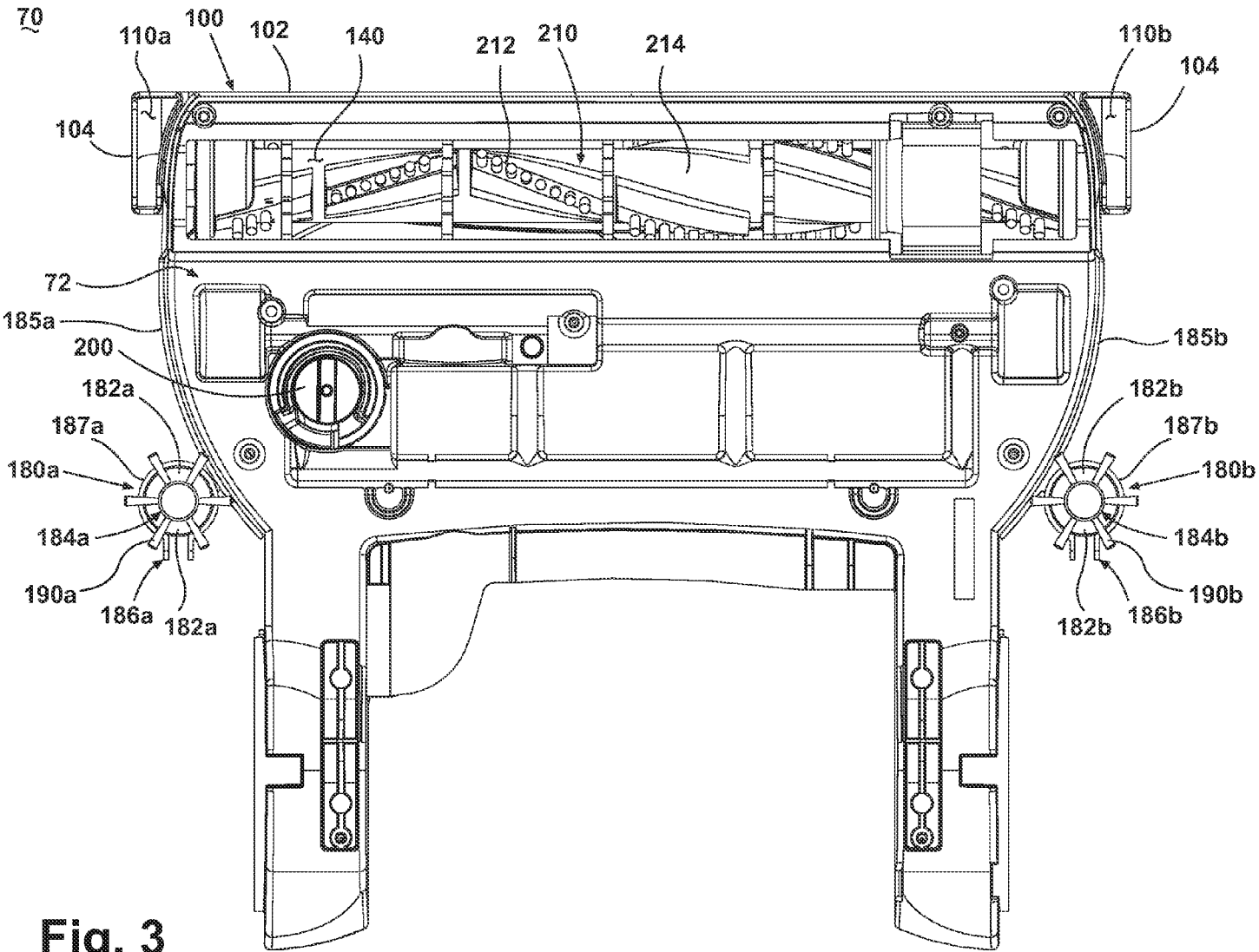
FIG. 3 is a bottom view of the foot assembly of FIG. 2 illustrating a main suction nozzle and an edge nozzle assembly.
Figure 4:
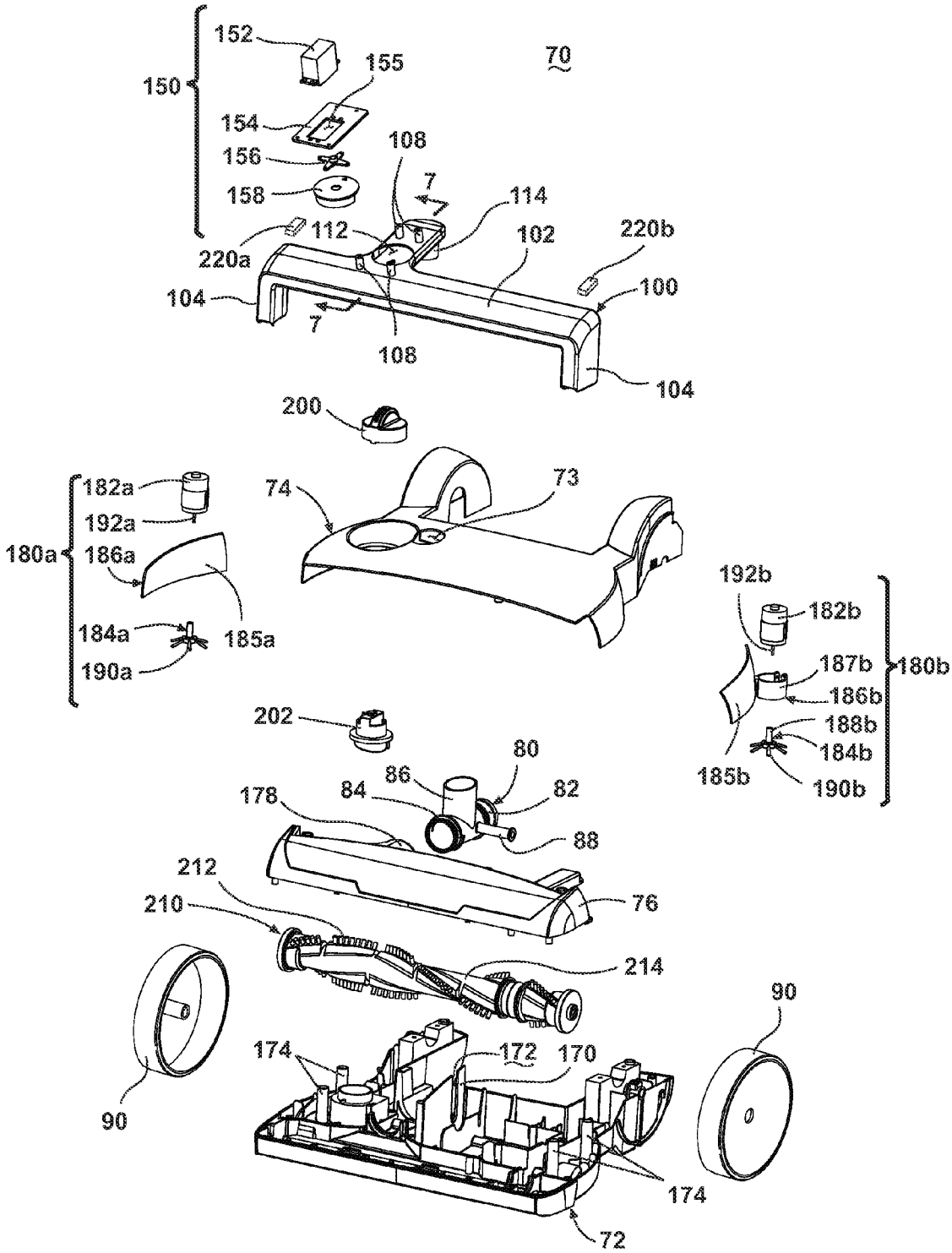
FIG. 4 is an exploded view of the foot assembly of FIG. 2.
Figure 5:
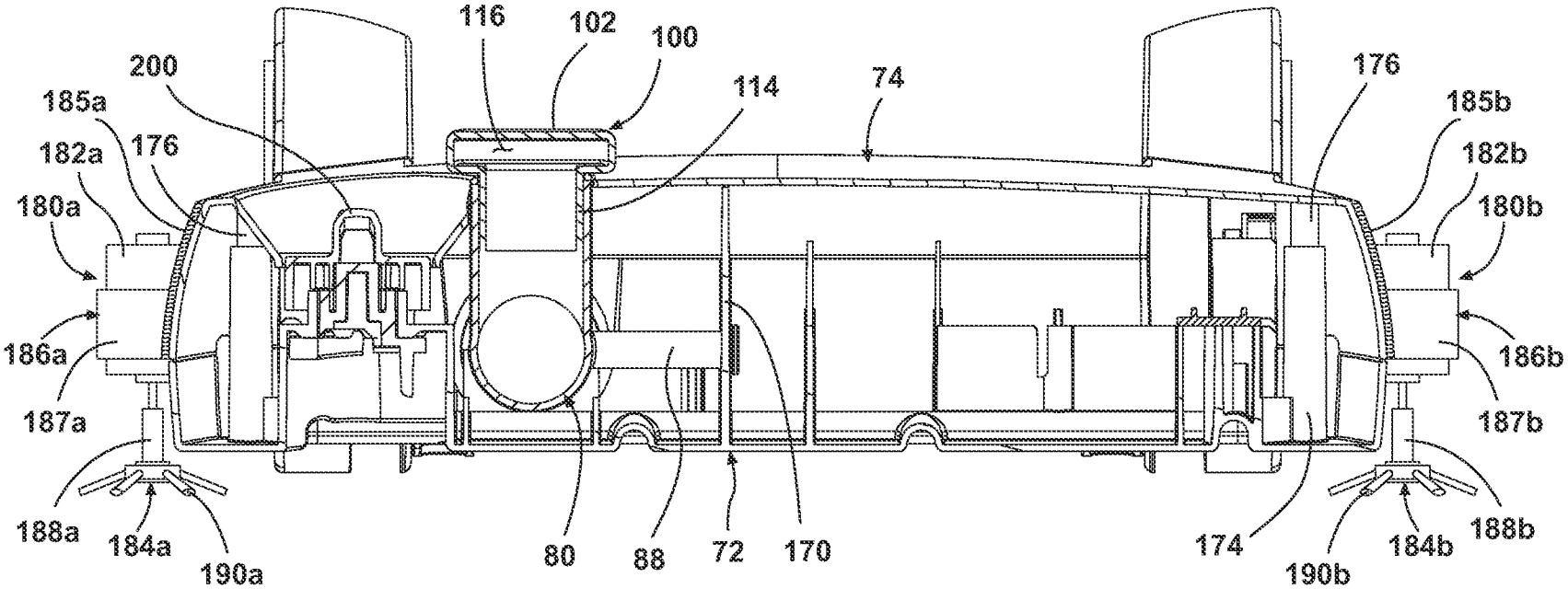
FIG. 5 is a cross-sectional view of the foot assembly of FIG. 2 taken along the line 5-5 illustrating the edge nozzle assembly suction path.

Referring now to FIGS. 3-5, a working air stream conduit 80 is disposed within a cavity between the bottom housing portion 72 and top housing portion 74 of the foot assembly 70 and is in fluid communication with either a main nozzle 140 via air stream conduit 84 or edge nozzles 110*a*, 110*b* of the edge nozzle assembly 100 via air stream conduit 86 to the main body air stream conduit 54. The main body air stream conduit 54 is fluidly coupled to the foot assembly air flow conduit 80 at air stream conduit 82. An air stream conduit 86 protrudes into an orifice 73 formed in the top housing portion 74 and is fluidly coupled to an air stream output tube 114 of the edge nozzle assembly 100 to guide the working air stream therein. The air stream conduit 84 associated with the main nozzle 140 is fluidly coupled to a main nozzle conduit 178 formed in the front housing portion 76 to guide the working air stream from the main nozzle 140. The foot assembly air stream conduit 80 is held in position by a positioning element 88 engaging a cut-out 172 in a positioning wall 170 protruding upwardly from the bottom housing portion 72.

The top housing portion 74 is mechanically attached to the bottom housing portion 72 with a plurality of bosses 176 projecting downwardly from the top housing portion 74 and engaging corresponding mounting sleeves 174 projecting upwardly from the bottom housing portion 72.

The diverter assembly 150 comprises a diverter motor 152 mounted on a mounting plate 154 to selectively rotate a rotor 156 which in turn controls a diverter 158 positioned within a cavity 112 in the edge nozzle assembly 100 and controls the working air stream path therein. In one embodiment, the diverter motor 152 is a stepper motor comprising a brushless, synchronous electric motor that converts digital pulses into mechanical shaft rotation to provide precise positioning and repeatable movement of the diverter 158. The mounting plate 154 has a rectangular hole 155 formed therein and is seated upon four diverter assembly feet 108 on top of the edge nozzle assembly 100 to hold the diverter motor 152 above the mounting plate 154 and the rotor 156 and diverter 158 under the mounting plate 154. The diverter motor 152 is operably coupled to the rotor 156 through the rectangular hole 155.

The front housing portion 76 has a rotatable agitator 210 disposed therein that is rotatably mounted adjacent the main nozzle 140 between the bottom housing portion 72 and the front housing portion 76. The agitator 210 comprises a brushroll 214 with a plurality of brush tufts 212 attached thereto. The brush tufts 212 protrude outwardly beyond the bottom surface of the bottom housing portion 72 and engage the surface to be cleaned.

The foot assembly 70 further comprises a height adjustment knob 200 that can be rotated to select a desired height of the main nozzle 140 relative to the surface to be cleaned and engages a height adjuster 202 to adjust the main nozzle 140 height up or down.

The brush motors 182*a* and 182*b* can comprise rotatable brush shafts 192*a* and 192*b* that are rotatably coupled to the brush hubs 188*a* and 188*b*. The brush motors can comprise any known type of electric motor including conventional brushed, brushless direct current, universal, or alternating current induction motor configurations, for example. A non-limiting example of an appropriate brush motor for this application is a Tranmotec RF-130 series brushed 6 volt permanent magnet DC motor. The brush motors 182*a* and 182*b* can be selectively controlled or energized such that either the right side brush motor 182*a* rotates, the left side motor 182*b* rotates, or neither the left 182*b* or the right side 182*a* motors rotate.

The housing portions 72, 74, and 76, the brushroll 214, wheels 90, the edge nozzle assembly 100, the brush assembly mounts 186*a* and 186*b*, the brush hubs 188*a* and 188*b*, and the foot assembly air stream conduit 80 may be fabricated by any known methods and materials, including, but not limited to, injection molding of thermo-plastics, thermosets, or elastomers, extrusion of thermoplastics or metals, die-casting of metals, sintering of ceramics, or combinations thereof. The wheels 90 may optionally have an outer tread comprising an elastomeric material with a high coefficient of static friction to promote better grip to the surface being cleaned, such as hardwood or linoleum floor.

The brush tufts 190*a* and 190*b* and the agitator brush tufts 212 can comprise assorted materials or combinations thereof, including a plurality of flexible bristles of natural or synthetic fibers, such as nylon strands or animal hair. Deformation of the brush tufts 190*a* and 190*b* is advantageous, especially when they come in contact with walls, baseboards, and toe kicks underneath conventional kitchen cabinets. Although six brush tufts 190*a* and 190*b* are shown, there may be any number of brush tufts disposed on the brushes 184*a* and 184*b*. The brush tufts 190*a* and 190*b* may be attached to the brush hubs 188*a* and 188*b* by any known method, including conventional staple tufting, overmolding, or insert molding, for example.

The proximity sensors 220*a* and 220*b* may be of any type including Infrared (IR) sensor comprising a position sensitive detector, infrared emitting diode, and a signal processing circuit. A non-limiting example of such a sensor is a Sharp® Distance Measuring Sensor Unit (Part #GP2Y0D810Z0F).

Figure 6:
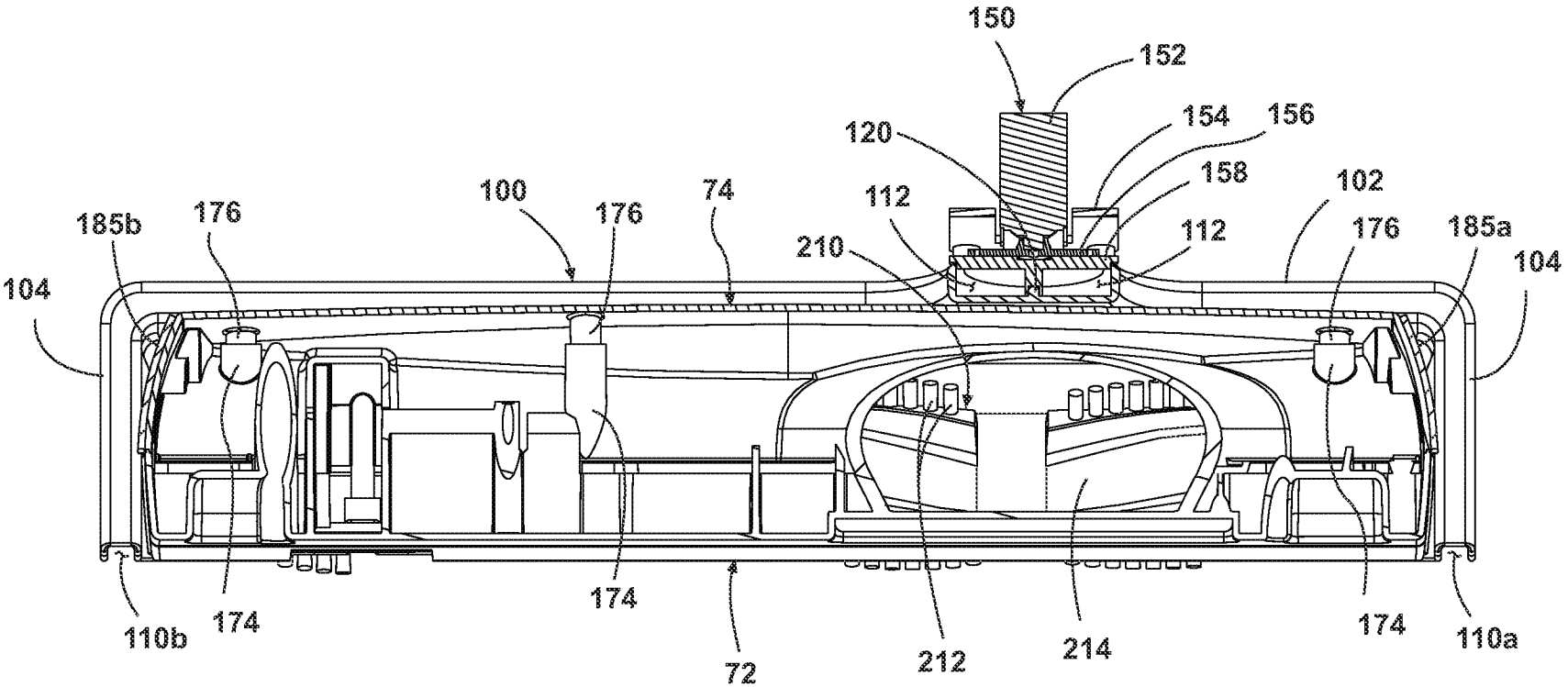
FIG. 6 is a cross-sectional view of the foot assembly of FIG. 2 taken along the line 6-6 illustrating the nozzle diverter mechanism.
Figure 7:
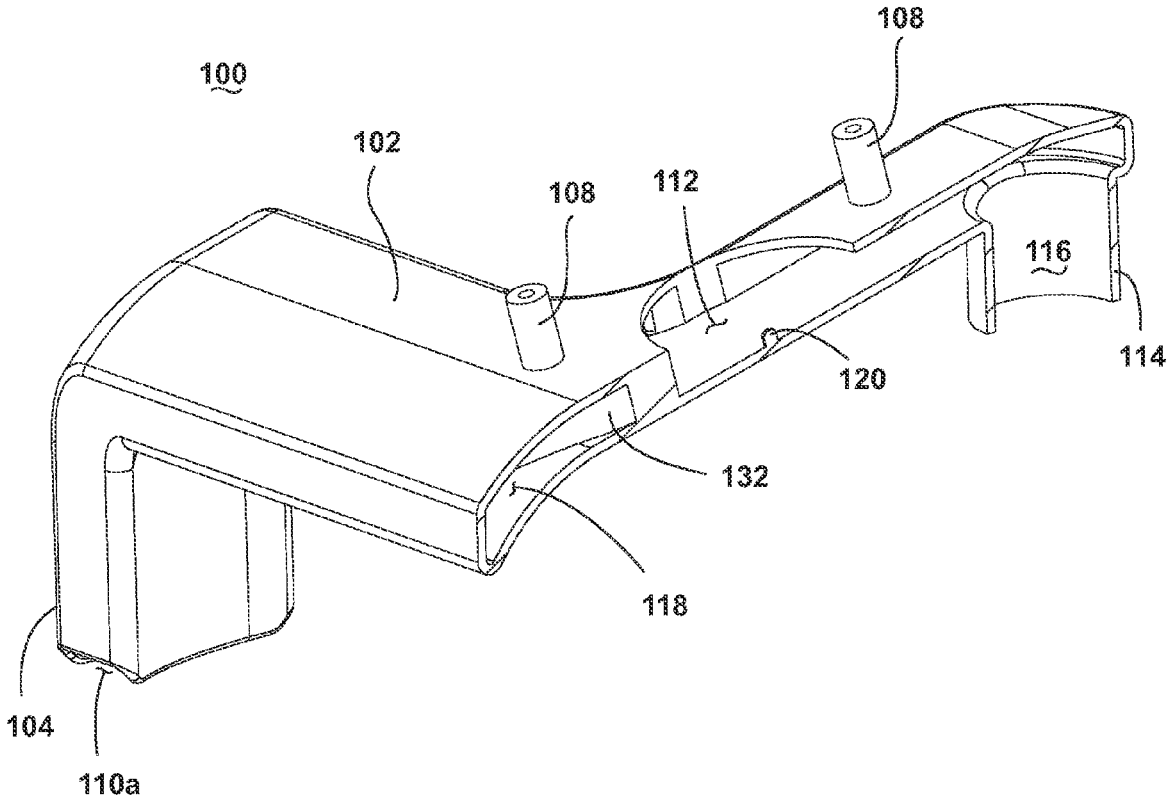
FIG. 7 is a cross-sectional view through the edge nozzle assembly taken along line 7-7 in FIG. 4.
Figure 8:
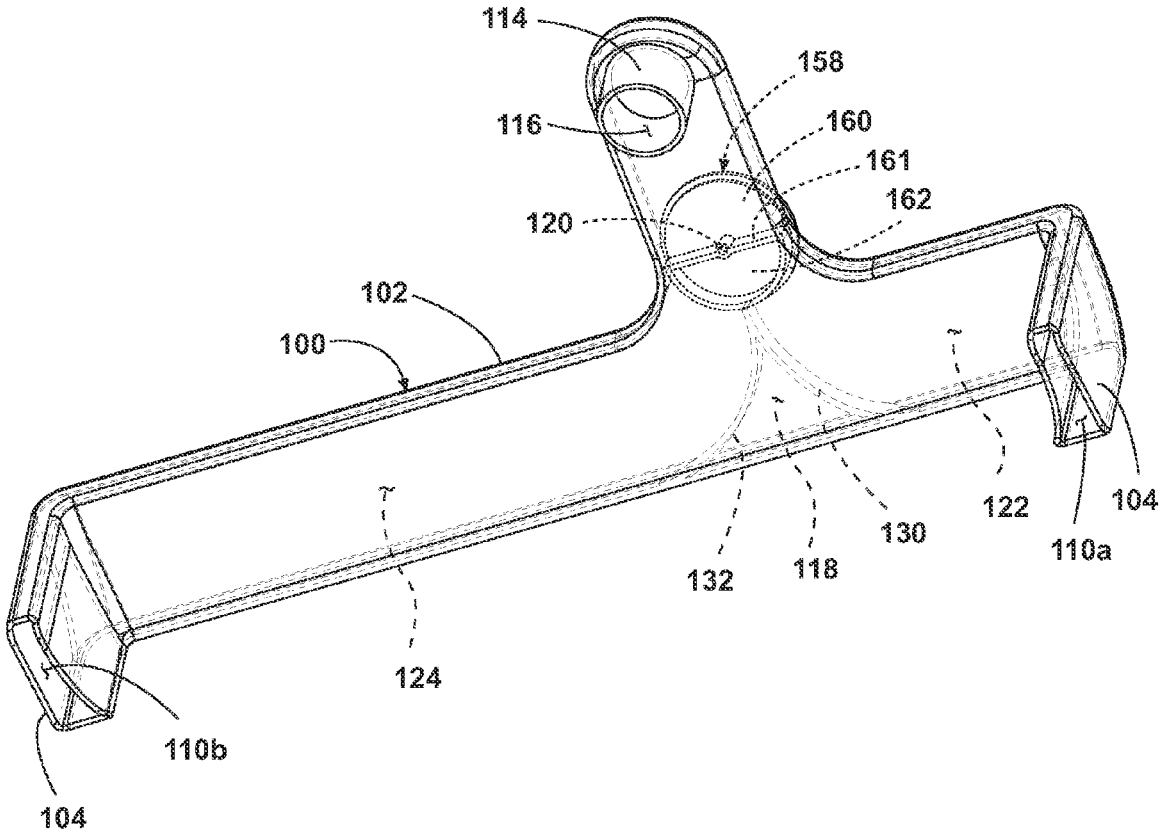
FIG. 8 is a bottom rear perspective view of the edge nozzle assembly with internal walls and a diverter shown in dotted lines.

Referring now to FIGS. 6-8, the diverter 158 is rotatably disposed on a mounting boss 120 within the edge nozzle assembly diverter cavity 112 such that the diverter 158 can freely rotate around a vertical axis of the mounting boss 120. The diverter 158 is further rotatably coupled to the diverter motor 152 via rotor 156, such that when the diverter motor 152 is selectively energized and controlled, the diverter 158 rotates. The diverter 158 further comprises a recessed section 160 and a protruded section 162 with a blocking face 161 between the recessed section 160 and protruded section 162 on the bottom side of the diverter 158.

The edge nozzle assembly 100 comprises a right air stream pathway 122 defined by a right diverting wall 130 and the middle housing portion 102 and is in fluid communication with right edge nozzle 110*a* and selectively in fluid communication with an edge nozzle assembly air stream output flow pathway 116. The edge nozzle assembly 100 also comprises a left air stream pathway 124 defined by a left diverting wall 132 and middle housing portion 102 and is in fluid communication with left edge nozzle 110*b* and selectively in fluid communication with the edge nozzle assembly air stream output flow pathway 116. Both the right and left diverting walls 130 and 132 within the interior of the edge nozzle assembly 100 have an arcuate shape to efficiently guide any air stream flowing through the edge nozzle assembly 100 and together define a non-flow cavity 118 within the edge nozzle assembly 100 where a working air stream does not flow.

Figure 9:
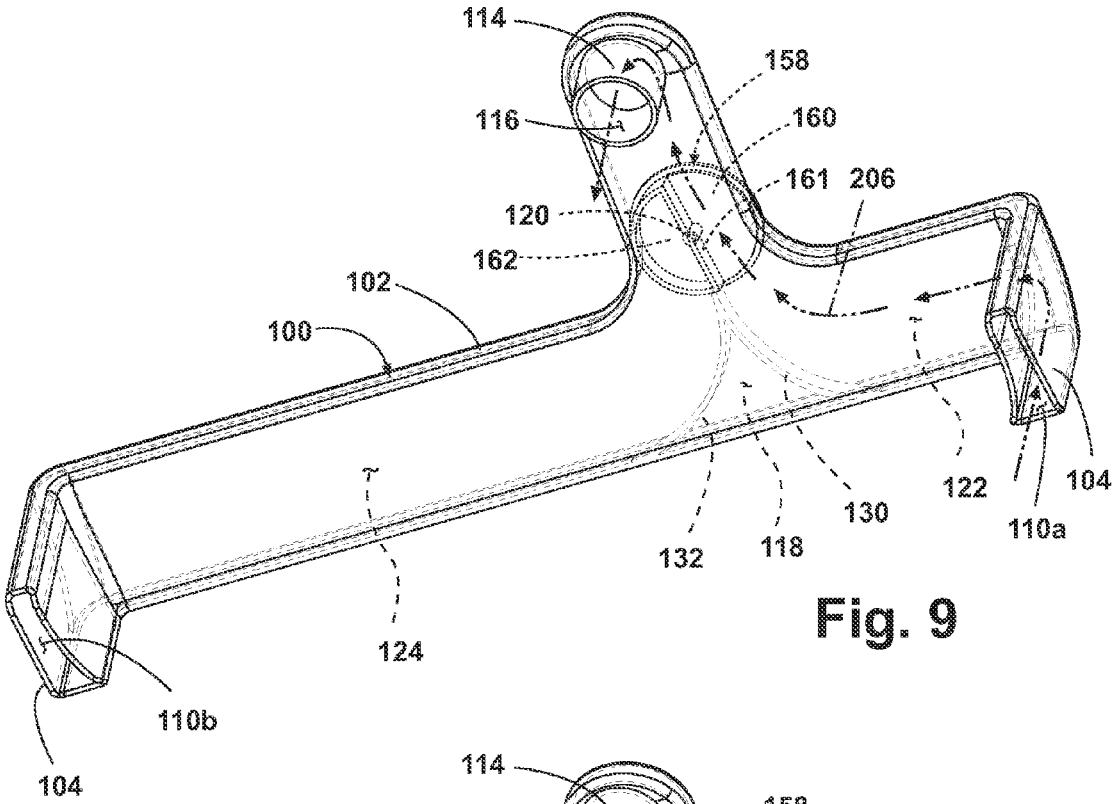
FIG. 9 is a bottom rear perspective view similar to FIG. 8 illustrating an air stream through a right nozzle.
Figure 10:
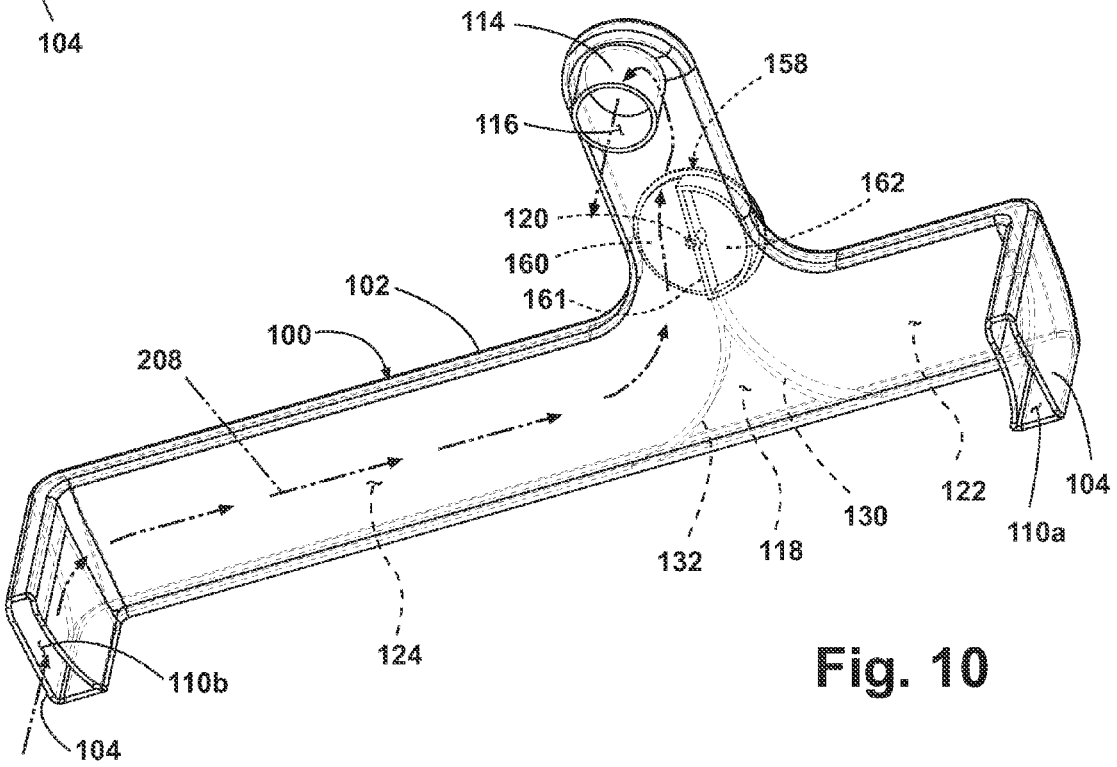
FIG. 10 is a bottom rear perspective view similar to FIG. 8 illustrating an air stream through a left nozzle.

Referring now to FIGS. 8-10, the operation of the diverter 158 and the resulting air stream flow within the edge nozzle assembly 100 is described. When the diverter motor 152 rotates the diverter 158 to a blocking position as depicted in FIG. 8, the blocking face 161 prevents the flow of an air stream between either of the edge assembly nozzles 110*a* and 110*b* and the air stream output flow path 116. As a result, neither edge nozzle 110*a* nor edge nozzle 110*b* is available for suction because the right air stream pathway 122 and the left air stream pathway 124 are blocked by the blocking face 161, which prevents the working airstream from flowing therethrough. In this position of the diverter 158 (i.e. with zero degree rotation or where the blocking face 161 is substantially parallel with the right and left air stream pathways 122, 124), the working air stream flows entirely through the main nozzle 140.

In contrast, as shown in FIG. 9, the diverter 158 is rotated so the blocking face 161 is substantially perpendicular to the right and left air stream pathways 122, 124 and the protruded section 162 blocks the flow of the working air stream through the left air stream pathway 124. This configuration rotates the diverter 158 clockwise to an angular orientation of +90 degrees, from the perspective of a user behind the vacuum cleaner 10. As a result, a working air stream 206 flows in through the right edge nozzle 110*a* into the right air stream pathway 122, along the right diverting wall 130 and through the air stream output pathway 116 to the downstream filtration chamber 42. In this configuration, the diverter motor 152 has rotated the diverter 158 clockwise by +90 degrees and the working air stream is split between the main nozzle 140 and the edge nozzle assembly right air stream pathway 122. A portion of the working air stream flows through the right edge nozzle 110*a* and right airstream pathway 122, while the remaining portion of the total air stream flows through the main nozzle 140. Therefore, there may be less airflow and reduced suction force through the main nozzle 140 when the diverter 158 is rotated to the position shown in FIG. 9 compared to the blocking position shown in FIG. 8.

In FIG. 10, the diverter 158 is rotated counter-clockwise by −90 degrees from the position shown in FIG. 8 so that the blocking face 161 is substantially perpendicular to the right and left air stream pathways 122, 124 and the protruded section 162 blocks the flow of the working air stream through the right air stream pathway 122. As a result, a working air stream 208 flows into the edge nozzle assembly 100 through the left edge nozzle 110*b*. The working air stream 208 is guided along through the left air stream pathway 124, along the left diverting wall 132 and through the output pathway 116 to the downstream filtration chamber 42. In this configuration, where the diverter motor 152 has rotated the diverter 158 by −90 degrees, a portion of the total air stream is diverted through the left edge nozzle 110*b* and the remaining portion of the total air stream is diverted through the main nozzle 140. Therefore, there may be reduced suction force through the main nozzle 140 in the configuration shown in FIG. 9 relative to the blocking position of FIG. 8. If the diverter 158 is rotated to an angular position less than +90 degrees, but more than 0 degrees, or between 0 degrees and −90 degrees, such as +65 degrees or −65 degrees, for example, it is possible to draw a portion of the total airstream through the right edge nozzle 110*a* or the left edge nozzle 110*b* in addition to the main nozzle 140.

During operation of the diverter assembly 150 in conjunction with the edge nozzle assembly 100, a working airstream can be diverted through only one of the right and left edge nozzles 110*a*, 110*b* independently. Alternatively, both right and left edge nozzles 110*a*, 110*b* can be blocked from the working airstream simultaneously, whereby the entire airstream is diverted to the main suction nozzle 140. The diverter assembly 150 can be controlled such that the diverter motor 152 actuates the orientation of the diverter 158 in a manner where the blocking face 161 and the protruded section 162 blocks air flow through either both the right and left air stream pathways 122 and 124, the left air stream pathway 124, or the right air stream pathway 122. When the vacuum cleaner 10 is energized, the working airstream flows through the main nozzle 140 regardless of whether or not one of the edge nozzles 110*a* and 110*b* has an air stream flowing therethrough.

Figure 11:
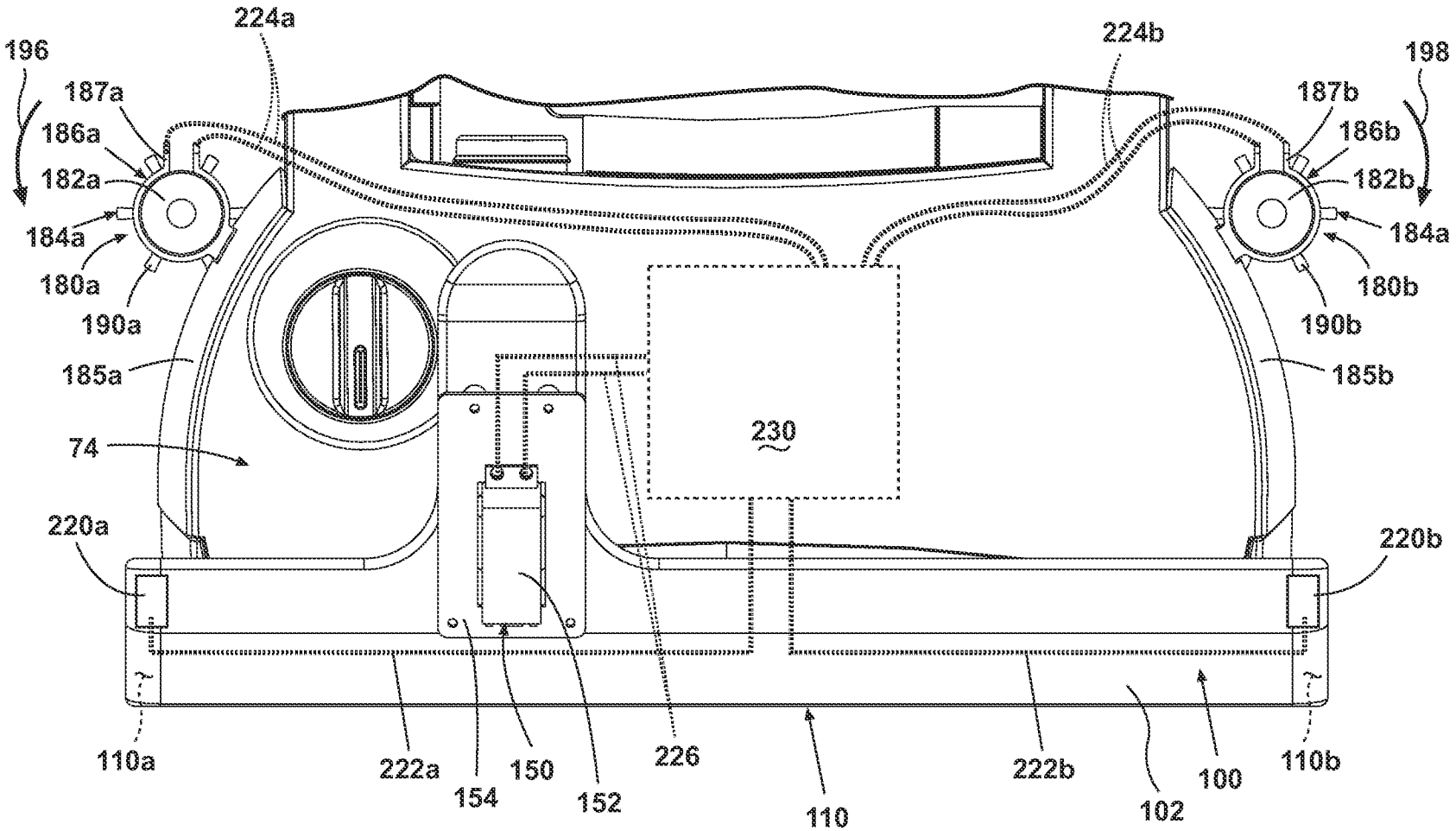
FIG. 11 is a schematic view of the foot assembly of FIG. 2 showing an edge cleaning control system.

Now referring to FIG. 11, the electrical controls for selectively energizing the brush assemblies 180*a* and 180*b* and controlling the diverter assembly 150 and, therefore, the flow of the working air stream through the edge nozzle assembly 100 are schematically illustrated. A controller 230 is coupled to both the right and left proximity sensors 220*a* and 220*b* via sensor communications paths 222*a* and 222*b*, respectively. The controller 230 is further coupled to the diverter assembly 150 via diverter communication path 226 and to the right and left brush motors 182*a* and 182*b* via motor communications paths 224*a* and 224*b*, respectively.

The controller 230 may comprise one or more processors, microcontrollers, memory devices, digital signal processors, field programmable gate arrays, integrated circuits, discrete electronic components, discrete passive components, circuit boards, electrical connectors, power supplies, or combinations thereof to control the diverter assembly 150. For example, the controller 230 can comprise a BASIC Stamp 2 microcontroller such as PIC16C57 series Microchip 2K 8-bit microcontroller.

The various communications paths 222*a*, 222*b*, 224*a*, 224*b*, and 226 can comprise a pair of wires providing for analog communications between the controller 230 and the right and left proximity sensors 220*a* and 220*b*, right and left motor assemblies 180*a* and 180*b*, and diverter assembly 150. Alternatively, the communications paths 222*a*, 222*b*, 224*a*, 224*b*, and 226 can be any known electronic communications methods and protocols. For example, wireless communications using any number of known protocols and standards such as ZigBee or Bluetooth may be used.

In operation, as the user pushes and pulls the vacuum cleaner 10 across a surface to be cleaned, one of the proximity sensors 220*a* and 220*b* may detect an object in proximity to the one or the other side of the vacuum cleaner 10. Some non-limiting examples of objects in proximity to the vacuum cleaner 10 during use are, but are not limited to, a wall, a baseboard, cabinetry, or the base or feet of furniture. If the right proximity sensor 220*a* detects an object in proximity, it sends a signal to the controller 230 via communications path 222*a*. The controller 230 in turn energizes the right brush assembly 180*a* via motor control wire 224*a* in response to the proximity signal from the right proximity sensor 220*a*. As the right brush 184*a* rotates, dirt in proximity of the right brush

184*a* is swept to the front of the vacuum cleaner 10 in proximity of the right edge nozzle 110*a* and the main nozzle 140. In one aspect, the right brush 184*a* may rotate in a counter clockwise direction 196, when viewed from a user's perspective looking down on the foot assembly 70 from behind the vacuum cleaner 10, to effectively sweep dirt from the proximity of the detected object towards the right edge nozzle 110*a* and the main nozzle 140. Further, the controller 230 can simultaneously actuate the diverter assembly 150 via control wires 226 to provide suction through the right edge nozzle 110*a*. In other words, when an object is detected in proximity of the right side of the vacuum cleaner 10 by the proximity sensor 220*a*, the controller 230 selectively energizes the right brush assembly 180*a* so the brush 184*a* rotates in a counter clockwise direction, while further actuating the diverter assembly 150 to divert a working air stream through both the right edge nozzle 110*a* and the main nozzle 140. No working air flows through the left edge nozzle 110*b* and the left brush 184*b* does not rotate.

Similarly, if the left proximity sensor 220*b* detects an object in proximity, it sends a signal to the controller 230 via communications path 222*b*. The controller 230 in turn energizes the left brush assembly 180*b* via motor control wire 224*b* in response to the proximity signal from the right proximity sensor 220*b*. As the right brush 184*b* rotates, dirt from the proximity of the right brush 184*b* can be swept to the front of the vacuum cleaner 10 in proximity of the left edge nozzle 110*b* and the main nozzle 140. The left brush 184*b* may rotate in a clockwise direction 198, when viewed from the user's perspective looking down on the foot assembly 70 from behind the vacuum cleaner 10, to effectively sweep dirt from the proximity of the detected object towards the left edge nozzle 110*b* and the main nozzle 140. Further, the controller 230 can simultaneously actuate the diverter assembly 150 via control wires 226 to divert suction through the left edge nozzle 110*b*. In other words, when an object is detected in proximity of the left side of the vacuum cleaner 10 by the proximity sensor 220*b*, the controller 230 selectively energizes the right brush assembly 180*b* so the right brush 184*b* rotates in a clockwise direction, while further actuating the diverter assembly 150 to divert a working air stream through both the left edge nozzle 110*b* and the main nozzle 140. No working air flows through the right edge nozzle 110*a* and the right brush 184*a* does not rotate.

The brushes 184*a* and 184*b* can be positioned on the vacuum cleaner 10 such that they are proximal to the object detected by the proximity sensors 220*a* and 220*b* such that when they rotate the brush tufts 190*a* and 190*b* are in contact with the detected object as the vacuum cleaner 10 is maneuvered over the surface to be cleaned. As an alternative, the brush tufts 190*a* and 190*b* may be close to, but not in contact with the detected object as the vacuum cleaner is maneuvered over the surface to be cleaned.

The brush motors 182*a* and 182*b* can rotate the brushes 184*a* and 184*b* at an angular velocity that is effective in sweeping dirt on the surface to be cleaned, such as an edge of a floor near a wall, so that dirt that comes in contact with the tufts 190*a* and 190*b* of the brushes 184*a* and 184*b* are effectively swept to the front of the vacuum cleaner 10 to be entrained in the working air stream through one of the edge nozzles 110*a* and 110*b* and the front nozzle 140.

Figure 12:
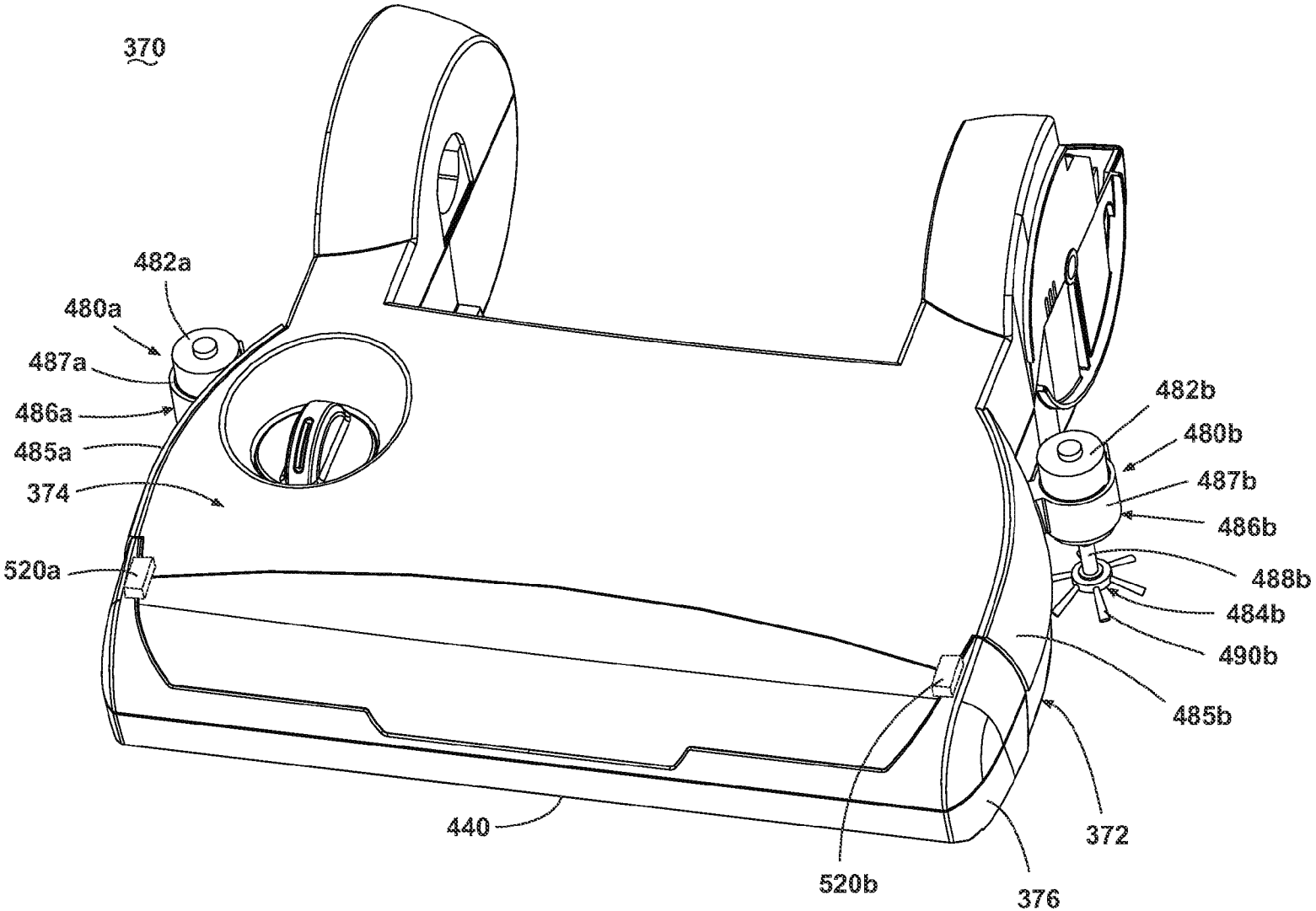
FIG. 12 is a front perspective view of a vacuum cleaner foot assembly according to another embodiment of the invention.
Figure 13:
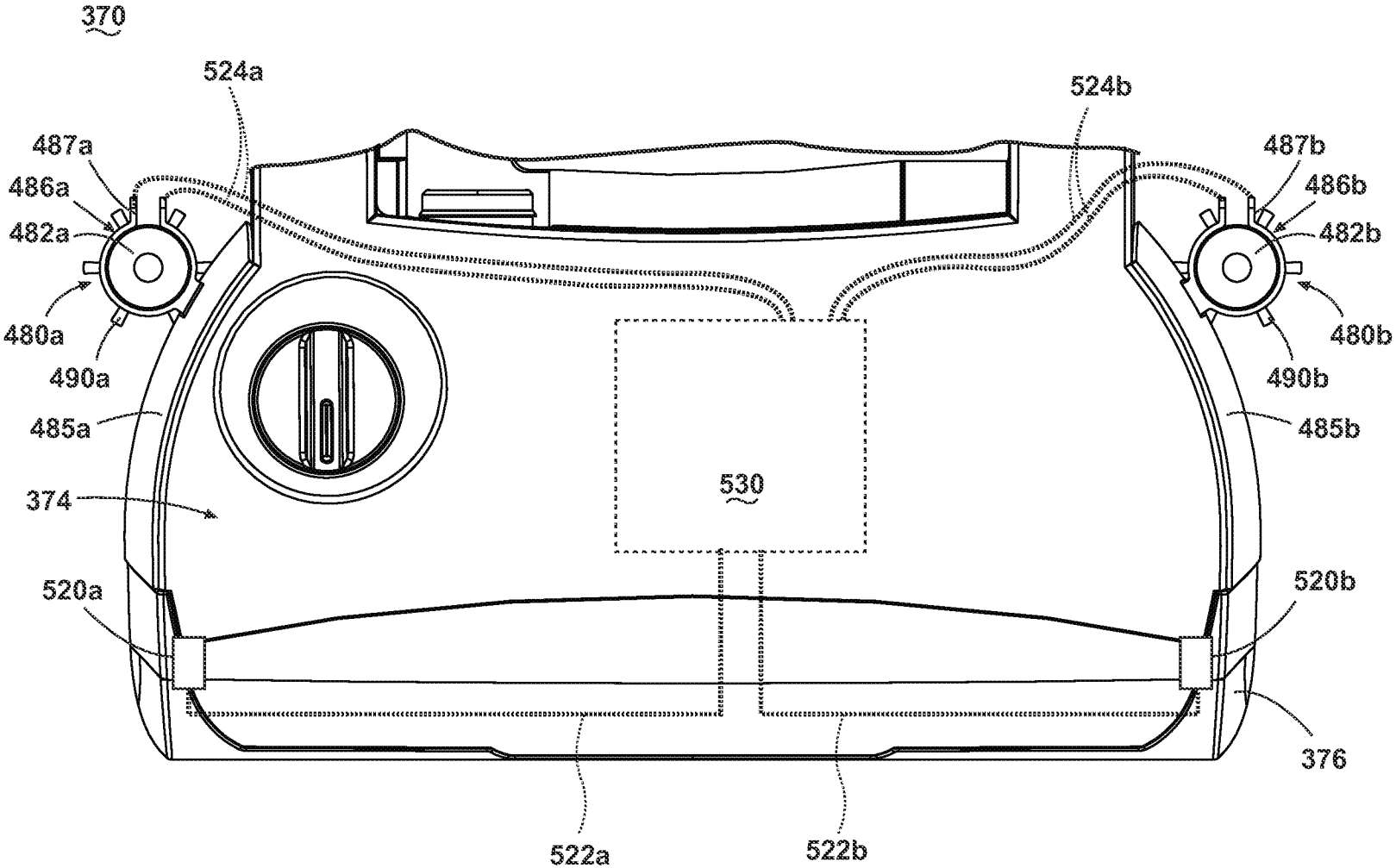
FIG. 13 is a schematic view of a control system of the vacuum cleaner foot assembly of FIG. 12.

FIGS. 12 and 13 show another embodiment of a foot assembly 370. In contrast to the foot assembly of 70 of FIG. 1-11, the foot assembly 370 does not comprise a diverter assembly to an edge nozzle assembly. The foot assembly 370 comprises a top housing portion 74 fixedly attached to a bottom housing portion 72 with a cavity formed therebetween, and a front housing portion 76. Right and left proximity sensors 520*a* and 520*b* are disposed on top of the front housing portion 376. A main nozzle 440 is disposed on the bottom side of the front housing portion 376 and adapted to ingest a working air stream that transports entrained dirt from the surface to be cleaned through a working air path to a filtration system downstream of the foot assembly 370. A right and left brush assembly 480*a* and 480*b*, similar to brush assemblies 180*a* and 180*b* of foot assembly 70, are disposed on opposed sides of the top housing section 374.

The brush assemblies 480*a* and 480*b* comprise brush motors 482*a* and 482*b* operably connected to brushes 484*a* and 484*b*, and mounted to the housing 374 by brush assembly mounts 486*a* and 486*b*. The brush assembly mounts 486*a* and 486*b* further comprise housing mounts 485*a* and 485*b* to attach the brush assembly mounts 486*a* and 486*b* to the side of the top housing portion 374 and motor holders 487*a* and 487*b* attached to the housing mounts 485*a* and 485*b* and for holding the brush motors 482*a* and 482*b*. The brushes are comprised of brush hubs 488*a* and 488*b* that operably couple with the brush motors 482*a* and 482*b*, and comprise brush tufts 490*a* and 490*b* protruding outwardly from the brush hubs 488*a* and 488*b* to sweep dirt from the surface to be cleaned.

The electrical controls for selectively energizing the brush assemblies 480*a* and 480*b* include a controller 530 communicatively coupled to both the right and left proximity sensors 520*a* and 520*b* via sensor communications paths 522*a* and 522*b*, respectively. The controller 530 is further communicatively coupled to the right and left motor assemblies 480*a* and 480*b* via motor control wires 524*a* and 524*b*, respectively.

Figure 14:
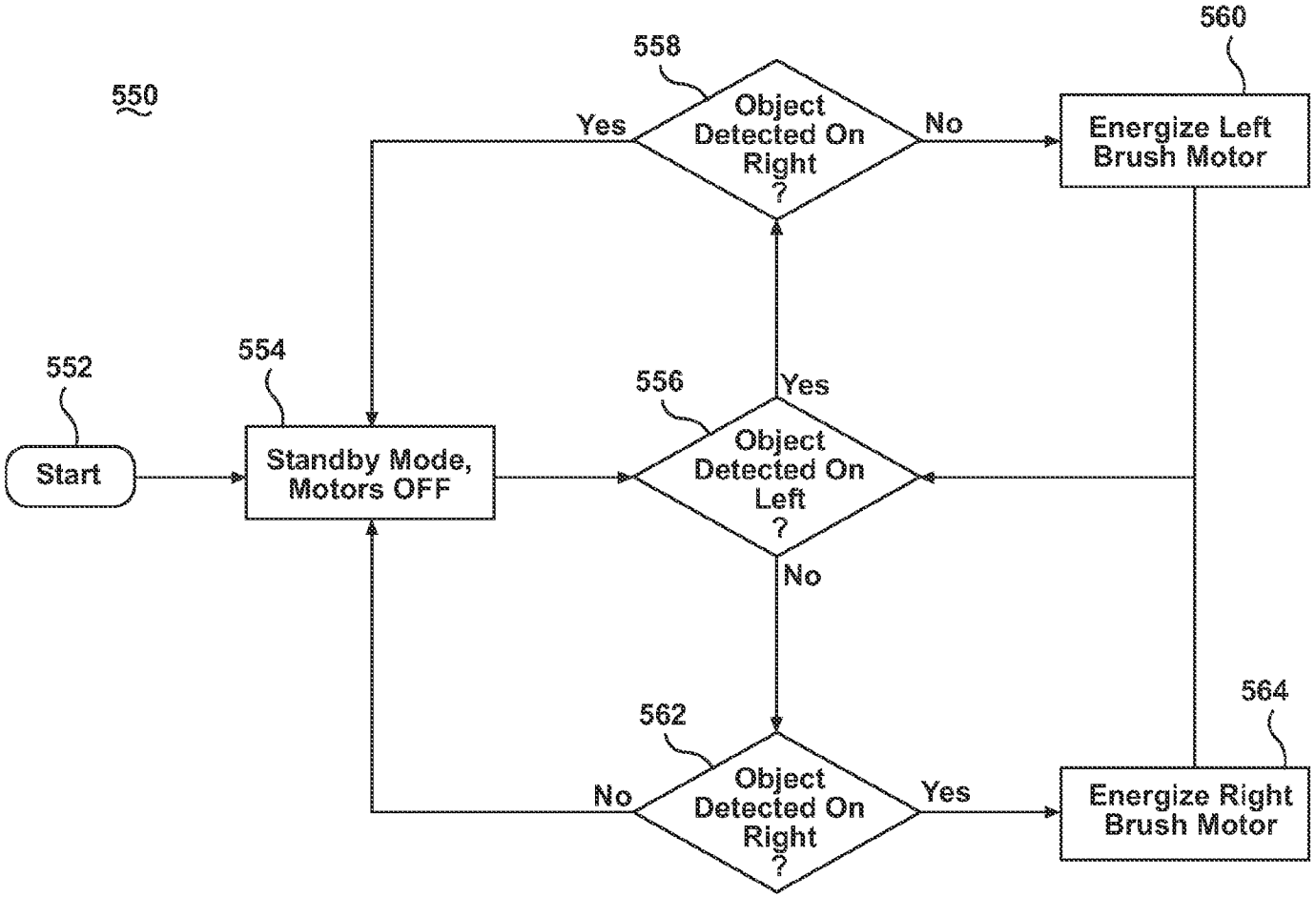
FIG. 14 is a flow diagram of a method of controlling edge brush assemblies of the vacuum cleaner foot assembly of FIG. 13.

FIG. 14 is a flow diagram of a method 550 of controlling the edge brush assemblies 480*a* and 480*b* of the foot assembly 370 of FIG. 13. At the starting point 552, the brush motors 482*a* and 482*b* are not energized and the brush assemblies 480*a* and 480*b* are in a standby mode at 554. The controller 530 polls the left sensor 520*b* to determine if an object is detected on the left side at 556. If at 556 an object is detected in proximity to the left proximity sensor 520*b*, the controller 530 polls the right proximity sensor 520*a* to determine if an object is detected on the right side at 558. If an object is not detected on the right side at 558, then the controller 530 energizes the left brush motor at 560 and then loops back to determining if an object is detected on the left at 556. If an object is detected by the right proximity sensor 520*a* at 558 then the method 550 loops back to 554 where both brush motors 482*a* and 482*b* are not energized. In either case, the controller 530 repeatedly polls the left proximity sensor at 556. At any point during the method 550 if it is determined at 556 that an object is not detected on the left side, is the controller then polls the right sensor 520*a* to determined if an object is detected on the right side at 562. If an object is not detected on the right side by proximity sensor 520*a* at 562, then the motors remain in an unenergized standby mode at 554 and the method 550 loops back to determining if an object is detected on the left side at 556. If, however, an object is detected on the right side at 562, then the right brush motor is energized at 564 and the method 550 loops back to determining if an object is detected on the left side at 556.

In summary the method 550 comprises a logic sequence and controller 530 that rotates the right edge brush 484*a* when an object is detected on the right side and not on the left side of the foot assembly 370. As a result the right edge brush 484*a* can sweep dirt from the surface being cleaned, for example near the edge of a floor in proximity to a wall, to the path of the main nozzle 440 of the foot assembly 370. The right edge brush 484*a* may rotate in a counter clockwise direction, when looking from the top down, to effectively sweep dirt from the proximity of the detected object to the proximity of the main nozzle 440. Similarly, the controller 530 rotates the left edge brush 484*b* when an object is detected on the left hand side of the foot assembly 370, but not on the right hand side. The right edge brush 484*a* can sweep dirt from the surface being cleaned, for example near the edge of a floor in proximity to a wall, to the path of the main nozzle 440 of the foot assembly 370. If an object is not detected on either side or an object is detected on both sides, then the controller 530 does not rotate either of the right or left brushes 484*a* and 484*b*. While the method 550 has been described as first polling the left proximity sensor 520*b* and then the right proximity sensor 520*a*, it is within the scope of the invention for this to be reversed. Moreover, the sensors 520*a*, 520*b* can be adapted to emit an output signal when an object is not detected and withhold an output signal upon detecting an object. Still further, the logic can be amended so that the controller 530 rotates both the right and left brushes 484*a* and 484*b* if objects are detected on both the right and left hand sides of the foot assembly 370.

In the foregoing discussion, dirt is used generally as the material that is being removed from the surface to be cleaned. Dirt can include dust, debris, organic or inorganic particles, including human and animal based debris such as dead skin cells and hair. The surface to be cleaned can include any surface including floors, carpets, and rugs. However, the brush assemblies 180*a*, 180*b*, 480*a*, 480*b* and the related cleaning methods described are particularly suited for cleaning floors, including wood, hardwood, linoleum, plastic, ceramic, concrete, tile, textured concrete, stone, or metal floors.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims. For example, the sequence of steps depicted in each method described herein is for illustrative purposes only, and is not meant to limit the disclosed methods in any way as it is understood that the steps may proceed in a different logical order or additional or intervening steps may be included without detracting from the invention.

What is claimed is:

1. A suction nozzle for a vacuum cleaner, comprising:

a nozzle body comprising a nozzle suction inlet adapted to be fluidly interconnected to a source of suction;

a first side brush rotatably mounted to the nozzle body near a first side of the nozzle body;

a first motor operably coupled with the first side brush for selectively rotating the first side brush;

a second side brush rotatably mounted to the nozzle body near a second side of the nozzle body;

a second motor operably coupled with the second side brush for selectively rotating the second side brush;

a controller operably connected to the first motor and the second motor;

a first proximity sensor operably connected to the controller and adapted to send an output signal to the controller upon sensing an obstacle proximate to the first side of the nozzle body; and a second proximity sensor operably connected to the controller and adapted to send an output signal to the controller upon sensing an obstacle proximate to the second side of the nozzle body;

wherein the controller energizes the first motor to rotate the first side brush only in response to the output signal from the first sensor and the controller energizes the second motor to rotate the second side brush only in response to the output signal from the second sensor.

2. The suction nozzle of claim 1, wherein the first and second side brushes are rotatably mounted to opposite sides of the nozzle body.

3. The suction nozzle of claim 1, wherein the two side brushes comprise a right-hand brush mounted to rotate in a first direction and a left-hand brush mounted to rotate in a second direction that is opposite the first direction.

4. The suction nozzle of claim 3, wherein the first and second directions of rotation of the two side brushes are selected to direct debris toward the suction inlet.

5. The suction nozzle of claim 1, wherein the first and second side brushes are rotatably mounted about substantially vertical axes.

6. The suction nozzle of claim 1, further comprising at least one edge suction inlet selectively fluidly interconnected to the source of suction and provided near the side of the nozzle body.

7. The suction nozzle of claim 1, further comprising an agitator brush positioned in the nozzle body adjacent to the nozzle suction inlet.

8. A vacuum cleaner having the suction nozzle of claim 1.

9. The vacuum cleaner of claim 8, comprising a foot assembly and an upright handle assembly pivotally mounted to the foot assembly for maneuvering the foot assembly over a surface to be cleaned, wherein the suction nozzle is provided on the foot assembly.

10. A suction nozzle for a vacuum cleaner, comprising:

a nozzle body comprising a nozzle suction inlet;

a first edge suction inlet provided near a side of the nozzle body;

a first side brush rotatably mounted near the side of the nozzle body;

a diverter assembly for selectively fluidly coupling one of the nozzle suction inlet and the first edge suction inlet with a source of suction and movable between a first position in which the nozzle suction inlet is fluidly coupled with the source of suction, and a second position in which the first edge suction inlet is fluidly coupled with the source of suction;

a controller operably connected to the diverter assembly; and a first sensor operably connected to the controller and adapted to send an output signal to the controller upon sensing an obstacle;

wherein the controller moves the diverter assembly to the second position and rotates the first side brush in response to the output signal from the first sensor.

11. The suction nozzle of claim 10, wherein the diverter assembly comprises a diverter and a diverter motor operably coupled with the diverter for selectively moving the diverter between the first and second positions.

12. The suction nozzle of claim 11, wherein the controller is operably connected to the diverter motor to energize the diverter motor in response to the output signal from the first sensor.

13. The suction nozzle of claim 11, further comprising a first motor operably coupled with the first side brush for selectively rotating the first side brush, wherein the controller energizes the first motor in response to the output signal from the first sensor.

14. The suction nozzle of claim 10, further comprising a second edge suction inlet provided on the nozzle body at an opposite side of the nozzle suction inlet from the first edge suction inlet.

15. The suction nozzle of claim 14, wherein the diverter assembly is movable between a third position in which the second edge suction inlet is fluidly coupled with the source of suction.

* * * * *